US006435954B1

(12) United States Patent
Heijkenskjöld

(10) Patent No.: US 6,435,954 B1
(45) Date of Patent: Aug. 20, 2002

(54) ABRASIVE MACHINE FOR MACHINING A FLANGE ON A WORK PIECE

(75) Inventor: Mats Heijkenskjöld, Lidköping (SE)

(73) Assignee: Lidkoping Machine Tools AB, Lidkoping (SE)

( * ) Notice: Subject to any disclaimer, the term of this patent is extended or adjusted under 35 U.S.C. 154(b) by 0 days.

(21) Appl. No.: 09/893,401

(22) Filed: Jun. 29, 2001

Related U.S. Application Data

(63) Continuation of application No. PCT/SE99/02442, filed on Dec. 21, 1999.

(30) Foreign Application Priority Data

Dec. 30, 1998 (SE) ..... 9804618

(51) Int. Cl.[7] ..... B24B 5/00
(52) U.S. Cl. ..... 451/180; 451/72; 451/52
(58) Field of Search ..... 451/180, 72, 56, 451/52, 49; 125/11.02, 11.18

(56) References Cited

U.S. PATENT DOCUMENTS 6,241,590 B1 * 6/2001 Heijkenskjold ..... 451/181

FOREIGN PATENT DOCUMENTS

| | | | | |
|---|---|---|---|---|
| SE | 512 250 C2 | | 2/2000 | |
| SU | 401474 | * | 10/1973 | ..... 451/52 |
| SU | 0542627 | * | 1/1977 | ..... 451/52 |
| SU | 1079412 | * | 3/1994 | ..... 451/52 |
| WO | WO 99/01253 | | 1/1999 | |
| WO | WO 99/01254 | | 1/1999 | |
| WO | WO 99/01255 | | 1/1999 | |

* cited by examiner

*Primary Examiner*—Robert A. Rose
(74) *Attorney, Agent, or Firm*—Burns, Doane, Swecker & Mathis, L.L.P.

(57) ABSTRACT

A machine for machining a flange on a work piece comprises a rotated tool, chucking equipment and feeding means for relative displacement between work piece and tool, a tubular cylindrical housing with longitudinal axis and an inner space, with an axis offset from the housing axis; a shaft with a recess in the inner space for angular displacement therein, a motor in the recess, a spindle coupled to the motor extending along the housing axis and cooperating with the chucking opening, the tool comprising a peripheral abrasive material at the central through opening, which extends axially beyond at least one of the lid surfaces, the shaft arranged in inner space for causing work piece to approach and contact the abrasive material at angular displacement of the shaft.

15 Claims, 3 Drawing Sheets

ABRASIVE MACHINE FOR MACHINING A FLANGE ON A WORK PIECE

This application is a continuation of International Application No. PCT/SE99/02442, filed on Dec. 21, 1999, which designates the United States and was published by the International Bureau in English on Jul. 13, 2000.

TECHNICAL FIELD

The present invention relates to an abrasive machine, in particular a grinder for removal of material from a flange on a work piece, the machine comprising a rotatably driven tool, chucking equipment for holding the work piece relative the rotatably driven tool and feeding means for effecting relative displacement between the work piece and the rotatably driven tool.

BACKGROUND OF THE INVENTION

Abrasive machines such as grinding machines, lapping machines, honing machines, milling machines, etc., are known in many slightly different designs and embodiments. It is desirous that the machine be compact and as space-saving as possible. For obtaining good machining results, it is on the other hand important that the cooperating parts of the machine have a high mutual stiffness and low tendencies of vibration. These last-mentioned properties are often obtained by giving the machine a heavy bedding and a sturdy and robust design, and therefore these two requirements are often contradictory to the desires for compactness and space-saving properties.

It is known from Swedish Patent Application Nos 9702587-8 and 9702588-6 to provide abrasive machines which at least partially fulfil the above properties. In both said applications, a machine is provided which comprises a tubular cylindrical housing having a longitudinal cylindrical inner space. The cylindrical inner space has a longitudinal axis which is offset from the longitudinal axis of the housing. A shaft is arranged for angular displacement in the cylindrical inner space and has a recess accommodating a motor which is coupled to a rotatable work head. The work head together with the chucking equipment is arranged to hold and rotate a work piece to be treated. The housing is enclosed by a rotatably driven outer casing, with the casing being firmly connected to a lid member having an opening forming at its inner edge a tool, such as a grinding wheel. When the shaft is angularly displaced, the work head is displaced with the work piece in a path allowing the work piece to approach and contact the inner periphery of the tool.

The construction of the machines disclosed in said patent applications implies that the work piece and the tool are supported in a very stable manner since only very short distances are present between the work piece and the shaft which supports the work piece. Furthermore, the arrangement of the tool along the inner periphery of the lid member also implies that the tool exhibits high stability. As a result, these machines exhibit superior precision compared to conventional machines having long support shafts which are subject to vibration and thermal effects.

The machines according to said Swedish patent applications are designed to be able to grind the outer and inner envelope surfaces respectively of annular work pieces. A need exists, however, for a machine which is capable of removing material from a flange on a work piece and/or for shaping the mantel surface of a cylindrical work piece.

SUMMARY OF THE INVENTION

It is therefore an object of the present invention to provide an abrasive machine which is capable of removing material from a flange on a work piece, which machine can offer superior precision compared to conventional such machines.

This object is achieved by means of a machine according to claim 1.

It is a further object of the invention to provide an abrasive machine which is capable of shaping the mantel surface of a cylindrical work piece.

This object is achieved by means of a machine according to claim 4 and a machine according to claim 6.

Preferred embodiments of the invention are detailed in the respective dependent claims.

BRIEF DESCRIPTION OF THE DRAWINGS

The invention will be described in greater detail in the following by way of example only and with reference to embodiments shown in the attached drawings, in which.

DETAILED DESCRIPTION OF PREFERRED EMBODIMENTS

Figure 1:
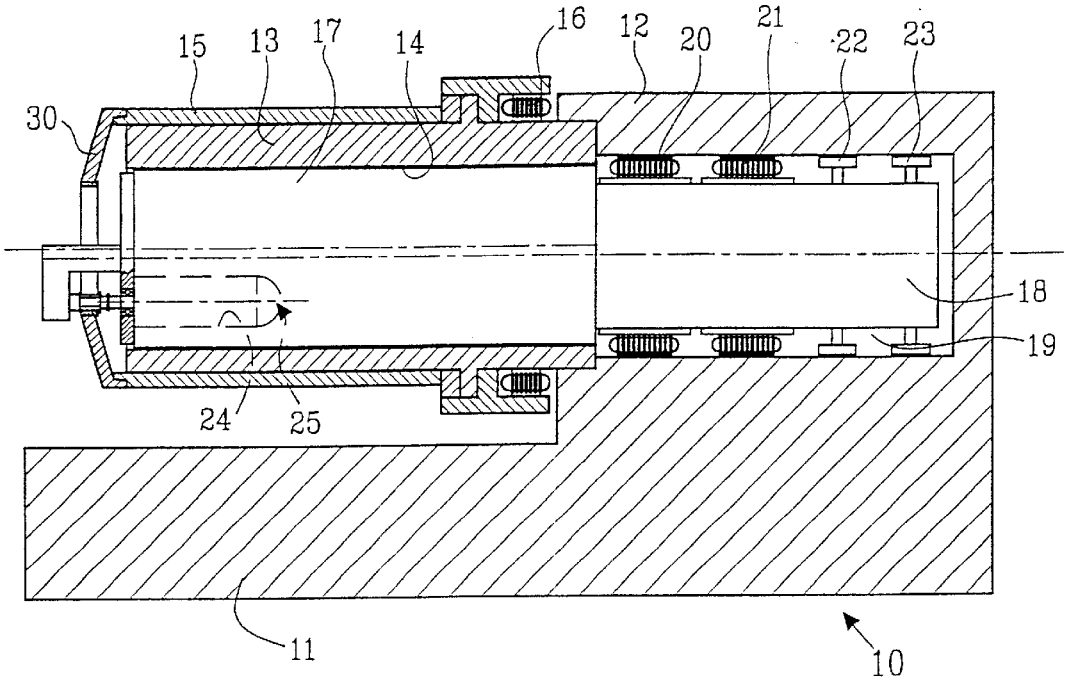
FIG. 1 shows in a schematic longitudinal sectional view a first embodiment of the abrasive machine according to the invention.

In the drawings, reference numeral 10 generally denotes an abrasive machine according to the present invention. The machine 10 incorporates a frame 11 which, in the shown embodiment, is designed as a machine bed having a portion 12 for supporting a cantilever housing. The cantilever housing is designed as an externally cylindrical and substantially tube-shaped elongate housing 13 extending about a longitudinal axis. The housing 13 is provided with a longitudinal cylindrical inner space 14 extending from a first end of the housing. The cylindrical inner space 14 has a longitudinal axis which is offset from the longitudinal axis of the cylindrical housing 13. The cylindrical housing 13 is preferably—although not necessarily—non-rotatably connected to the frame 11.

Rotatably supported on the outer envelope surface of the cylindrical housing 13 is a rotatable outer casing 15, a wheel carriage, which is driven by a motor 16, preferably an electric motor, carried by the housing 13. Inside the eccentric inner space 14 of the housing, there is provided a shaft 17 which can be revolved or indexed and displaced axially. In the shown embodiment the shaft 17 has a reduced diameter portion 18 projecting out from the housing inner space 14 in a direction towards the supporting portion 12 of the frame 11. The portion 18 of the shaft thus projecting from the housing is received in a space 19 provided in the portion 12 of the frame 11, and in which space there is provided means for revolving the shaft 17, preferably a torque motor 20, and means for axial displacement of the shaft 17, preferably a linear motor 21. The revolving and the axial displacement of the shaft is controlled by one or more sensors 22 and 23 respectively, which preferably are also accommodated in the space 19 of the frame portion 12. It is evident that the means for revolving and axially displacing the shaft need not be arranged in a manner as shown in the drawings, but may for instance be contained in a recessed portion of the shaft itself.

At its end opposite the reduced diameter portion 18, the shaft 17 is provided with a recess 24. The recess extends substantially axially into the shaft 17 and is adapted to receive a motor 25, for example an electric motor The motor 25 is provided with a spindle 26 which projects out of the recess 24. The motor is arranged within the recess such that the spindle 26 extends along an axis which is non-concentric with the longitudinal axis of the shaft 17. In the embodiment shown in FIGS. 1 and 2, the spindle extends along an axis which is substantially parallel to that of the longitudinal axis of the tubular cylindrical housing 13, whilst in the embodiments shown in FIGS. 3 and 4, the spindle extends at an angle to the longitudinal axis of the housing 13. Chucking equipment, generally denoted by reference numeral 27, cooperates with the spindle 26 to thereby hold and rotate a work piece 28. The work piece 28 may for example be an inner bearing race ring, though it is to be understood that any work piece having a surface which is to be treated can in principle be machined. The actual form of the chucking equipment 27 is of no particular significance and any conventional chuck arrangement which is suitable for clamping the work piece in question may be used, such as centric chucking, micro-centric chucking or magnetic chucking.

Figure 2:
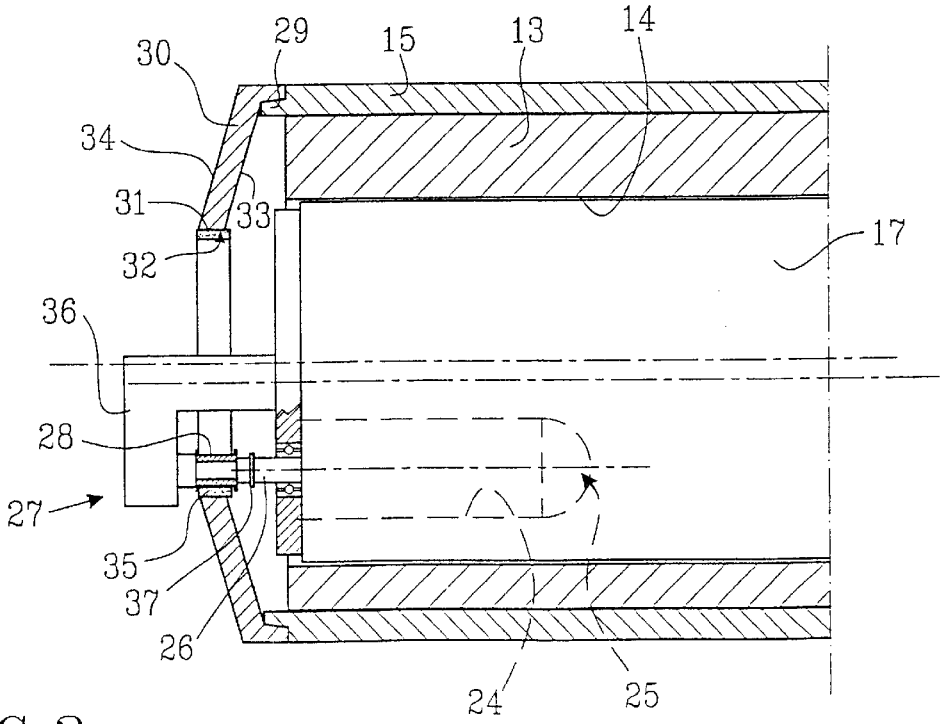
FIG. 2 is a schematic longitudinal sectional view on a greater scale of a part of the abrasive machine of FIG. 1.
Figure 3:
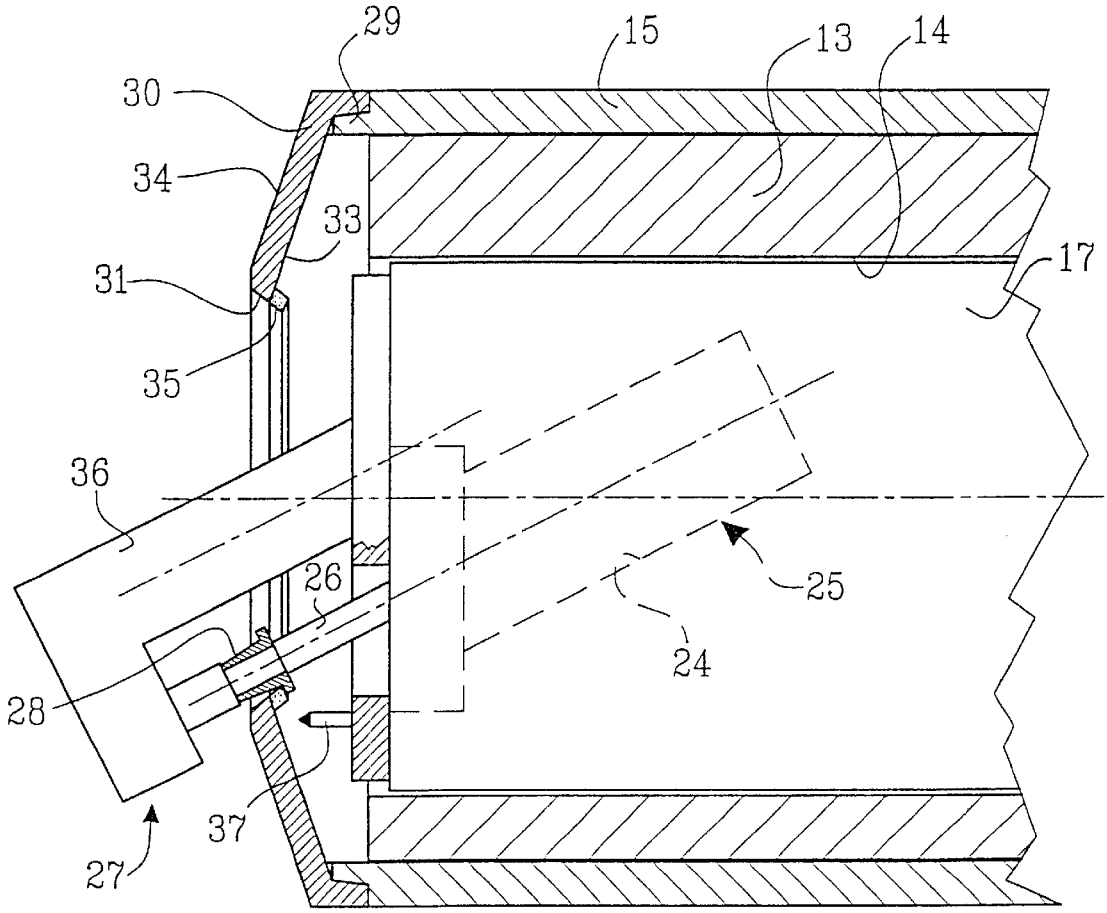
FIG. 3 is a view corresponding to FIG. 2, though of a second embodiment of the abrasive machine according to the invention.
Figure 4:
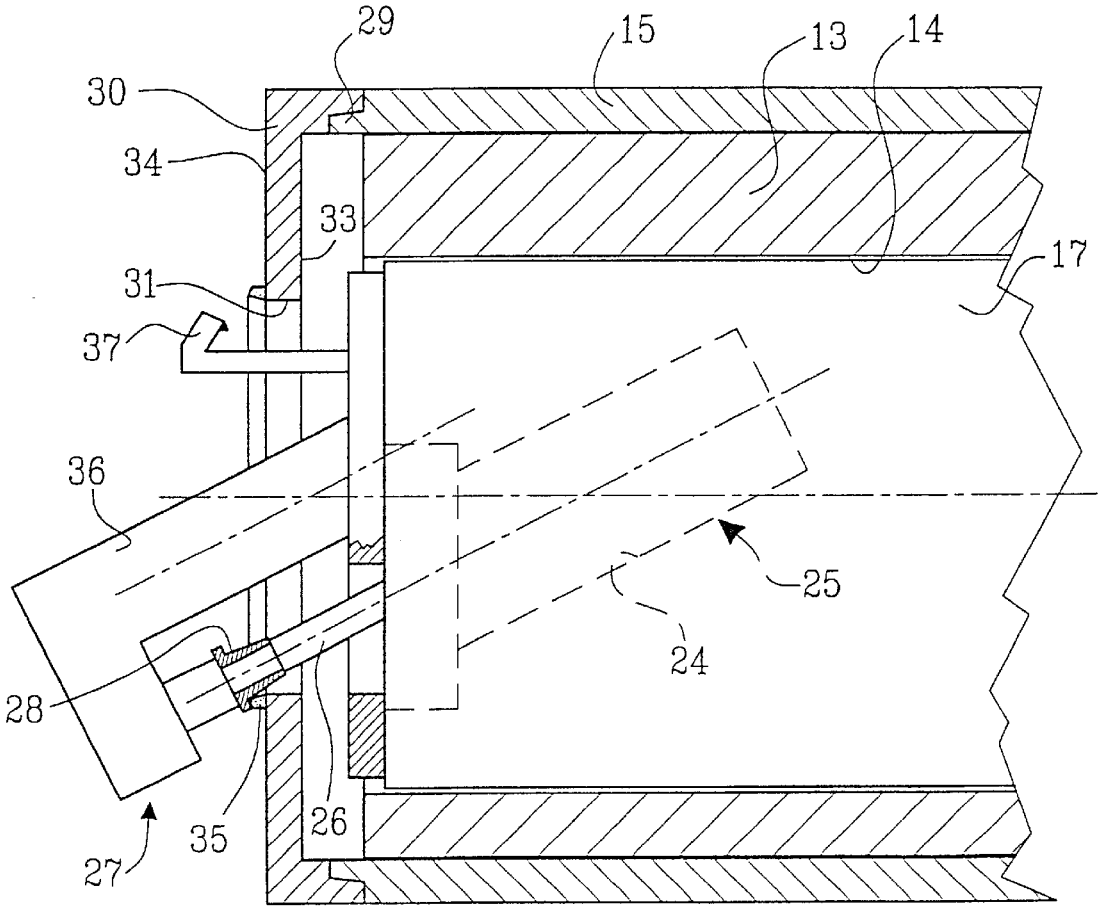
FIG. 4 is a view corresponding to FIG. 2, though of a third embodiment of the abrasive machine according to the invention.

As is most clearly apparent from FIGS. 2 to 4, the rotatable outer casing 15, or wheel carriage, extends axially beyond the first end of the housing 13 and terminates in a peripheral flange 29. A lid member 30 is firmly connected to the outer casing 15 via the peripheral flange 29 such that the lid member co-rotates with the outer casing. The connection between the lid member 30 may be permanent, e.g. a welded joint, or releasable. The lid member 30 extends radially over the first end of the tubular cylindrical housing 13 and is provided with a central through opening 31 having a peripheral surface 32. The peripheral surface 32 extends from an interior surface 33 of the lid member 30. i.e. that surface facing the first end of the tubular cylindrical housing 13, to an exterior surface 34.

Associated with the lid member 30, there is provided a rotatably driven tool 35. In the embodiment shown in FIGS. 1 and 2, the rotatably driven tool 35 comprises an annular region of abrasive material at least partially covering the peripheral surface 32 of the central through opening 31. To enable the tool 35 of the FIG. 1 and 2 embodiment to machine a flange on the work piece 28, the annular region of abrasive material extends axially beyond at least one, though preferably both, of the interior and exterior surfaces 33,34 of the lid member in the immediate vicinity of the through opening 31. Furthermore, the shaft 17 is arranged in the inner space 14 such that when the shaft executes an angular displacement in the inner space, the work piece 28 held by the chucking equipment 27 is caused to approach and contact the annular region of abrasive material 35.

In the embodiment illustrated in FIG. 3, the rotatably driven tool 35 comprises an annular region of abrasive material on the interior surface 33 of the lid member 30, whilst in the embodiment illustrated in FIG. 4, the rotatably driven tool 35 comprises an annular region of abrasive material on the exterior surface 34 of the lid member 30. To facilitate machining of a flange on the work piece 28 shown in FIG. 3, the peripheral surface 32 of the central through opening 31 in the lid member forms an angle to the longitudinal axis of the tubular cylindrical housing 13, which angle is greater than the angle subtended by the spindle 26.

Machining can also be achieved by displacement of the shaft 17 using the motor 21 in the axial direction towards the annular region 35 of abrasive material.

The abrasive material may be any material which is commonly used for grinding purposes. One example of such material is Cubic Boron Nitride. The abrasive material may be affixed to the lid member 30 by, for example, adhesive means or sintering.

Common to all three illustrated embodiments is that the chucking equipment advantageously comprises a support arm 36 extending parallel to the spindle 26 of the motor 25, with the support arm extending through the central through opening 31 of the lid member. In this manner, the work piece 28 can be supported at both axial ends.

The various embodiments of the invention may also be provided with a dressing tool 37 for ensuring the correct shape of the rotatably driven tool 35. In the embodiment shown in FIGS. 1 and 2, the dressing tool 37 is in the form of a disc carried by the spindle 26 of the motor 25. In the embodiments shown in FIGS. 3 and 4, the dressing tool 37 is carried by the shaft 17. Naturally, since the rotatably driven tool 35 in the FIG. 4 embodiment is on the exterior surface of the lid member 34, the dressing tool in this embodiment extends through the central through opening in the lid member 30.

With particular reference to FIGS. 2 to 4, the machine 10 is operated in the following manner.

Since the shaft 17 is accommodated for rotation and axial displacement in the cylindrical inner space 14, and the inner space has a longitudinal axis which is offset from the longitudinal axis of the housing 13, it follows that rotation of the shaft 17 will cause the axis of the spindle 26 to approach or move away from the rotatably driven tool 35, depending on in which direction the shaft 17 is rotated. Thus, to insert the work piece 28, the shaft 17 within the tubular cylindrical housing 13 is caused to rotate in a first direction to thereby increase the distance between the spindle 26 and the rotatably driven tool 35 such that a gap is created which is sufficient to allow insertion of the work piece in the chucking equipment 37. Thereafter, rotation of the rotatable outer casing 15 and the motor 25 is initiated and the shaft 17 is rotated in a second direction and displaced axially such that the work piece contacts the rotatably driven tool 35 at a desired initial location. The position of the work piece relative the tool is adjusted by rotational and axial displacement of the shaft 17.

Once machining is completed, the motor 25 ceases to rotate, the shaft 17 is displaced in the first direction and the work piece 28 is removed.

To dress the rotatably driven tool 35 in the FIGS. 1 and 2 embodiment, the motor 25 and the outer casing 15 are rotated. The shaft 17 is axially displaced to the left as shown in FIG. 2 to cause the dressing tool 37 on the spindle 26 to approach the rotatably driven tool. By effecting rotation of the shaft 17, the radial position of the dressing tool 37 relative the rotatably driven tool 35 can be adjusted.

Dressing of the rotatably driven tool 35 in the embodiments shown in FIGS. 3 and 4 is effected by axially displacing the shaft 17 such that the dressing tool 35 carried by the shaft 17 approaches the rotatably driven tool 35 whilst the outer casing 15 is rotated. By effecting rotation of the shaft 17, the radial position of the dressing tool 37 relative the rotatably driven tool 35 can be adjusted.

The invention is not limited to the embodiment described above and shown in the drawings. Instead, all modifications and variations within the scope of the appended claims are to be deemed to be covered. For example, the cylindrical housing 13 has been shown having a cylindrical inner space. This space may also have a shape other than a cylindrical shape and the shaft 17 may have any appropriate cross-sectional shape which allows it to be turned or indexed within the inner space of the housing. The portion 18 of the shaft 17 received in the space 19 need not have a reduced diameter. It is further conceivable that the shaft be substituted for a system of articulated links or the like capable of Sung or indexing the spindle in an appropriate manner.

I claim:

1. An abrasive machine for shaping a mantel surface of a substantially cylindrical work piece comprising a rotatably driven tool, chucking equipment for holding said work piece relative said rotatably driven tool and feeding means for effecting relative displacement between said work piece and said rotatably driven tool, said machine further comprising:

a tubular cylindrical housing extending about a longitudinal axis, said housing having a longitudinal cylindrical inner space extending from a first end of said housing, said cylindrical inner space having a longitudinal axis which is offset from the longitudinal axis of said housing;

a shaft arranged in said inner space for angular displacement in said inner space, said shaft being provided with a recess;

a motor arranged in said recess;

a spindle coupled to said motor, said spindle extending at an angle to said longitudinal axis of said tubular cylindrical housing and cooperating with said chucking equipment to hold and rotate said work piece;

a rotatable outer casing peripherally enclosing said tubular cylindrical housing, and a lid member firmly connected to said outer casing for co-rotation with said outer casing, said lid member extending radially over said first end of said tubular cylindrical housing with said lid member being provided with a central through opening having a peripheral surface, said peripheral surface extending from an interior surface of said lid member facing said first end of said tubular cylindrical housing to an exterior surface;

wherein said rotatably driven tool comprises an annular region of abrasive material on said interior surface of said lid member, said annular region of abrasive material being concentric with said central through opening of said lid member;

and wherein said shaft is arranged in said inner space such that when said shaft executes an angular displacement in said inner space, said work piece held by said chucking equipment is caused to approach and contact said annular region of abrasive material.

2. The machine as claimed in claim 1, wherein said peripheral surface of said central through opening in said lid member forms an angle to said longitudinal axis of said tubular cylindrical housing, which angle is greater than said angle subtended by said spindle.

3. An abrasive machine for shaping a mantel surface of a substantially cylindrical work piece, said machine comprising a rotatably driven tool, chucking equipment for holding said work piece relative said rotatably driven tool and feeding means for effecting relative displacement between said work piece and said rotatably driven tool, said machine further comprising:

a tubular cylindrical housing extending about a longitudinal axis, said housing having a longitudinal cylindrical inner space extending from a first end of said housing, said cylindrical inner space having a longitudinal axis which is offset from the longitudinal axis of said housing;

a shaft arranged in said inner space for angular displacement in said inner space, said shaft being provided with a recess;

a motor arranged in said recess;

a spindle coupled to said motor, said spindle extending at an angle to said longitudinal axis of said tubular cylindrical housing and cooperating with said chucking equipment to hold and rotate said work piece;

a rotatable outer casing peripherally enclosing said tubular cylindrical housing, and a lid member firmly connected to said outer casing for co-rotation with said outer casing, said lid member extending radially over said first end of said tubular cylindrical housing with said lid member being provided with a central through opening having a peripheral surface, said peripheral surface extending from an interior surface of said lid member facing said first end of said tubular cylindrical housing to an exterior surface;

wherein said rotatably driven tool comprises an annular region of abrasive material on said exterior surface of said lid member, said annular region of abrasive material being concentric with said central through opening of said lid member;

and wherein said shaft is arranged in said inner space such that when said shaft executes an angular displacement in said inner space, said work piece held by said chucking equipment is caused to approach and contact said annular region of abrasive material.

4. The machine as claimed in claim 1, wherein a dressing tool is carried by said shaft.

5. The machine as claimed in claim 1, wherein said shaft is acted upon by means for effecting axial displacement of said shaft.

6. The machine as claimed in claim 1, wherein said chucking equipment comprises a support arm extending substantially parallel to said spindle of said motor, said support arm extending through said central through opening of said lid member.

7. The machine as claimed in claim 1, wherein said lid member is releasably connected to said outer casing.

8. The machine as claimed in claim 5, wherein said shaft is provided with sensors for controlling rotational and axial displacement of said shaft.

9. The machine as claimed in claim 1, wherein said machine further comprises a support frame to which said tubular cylindrical housing is fixedly attached, and in that said outer casing is driven by a motor carried by the housing.

10. The machine as claimed in claim 3, wherein a dressing tool is carried by said shaft.

11. The machine as claimed in claim 3, wherein said shaft is acted upon by means for effecting axial displacement of said shaft.

12. The machine as claimed in claim 3, wherein said chucking equipment comprises a support arm extending substantially parallel to said spindle of said motor, said support arm extending through said central through opening of said lid member.

13. The machine as claimed in claim 3, wherein said lid member is releasably connected to said outer casing.

14. The machine as claimed in claim 11, wherein said shaft is provided with sensors for controlling rotational and axial displacement of said shaft.

15. The machine as claimed in claim 3, including a support frame to which said tubular cylindrical housing is fixedly attached, and in that said outer casing is driven by a motor carried by the housing.

* * * * *